US006781549B1

(12) United States Patent
Macqueen et al.

(10) Patent No.: US 6,781,549 B1
(45) Date of Patent: Aug. 24, 2004

(54) PORTABLE ANTENNA

(75) Inventors: Angus Macqueen, Lothian (GB); Alexander Berin, Nazareth Illit (IL)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 10/110,438

(22) PCT Filed: Oct. 6, 2000

(86) PCT No.: PCT/IL00/00633

§ 371 (c)(1),
(2), (4) Date: Jul. 15, 2002

(87) PCT Pub. No.: WO01/28033

PCT Pub. Date: Apr. 19, 2001

Related U.S. Application Data

(60) Provisional application No. 60/159,461, filed on Oct. 12, 1999.

(51) Int. Cl.[7] ..... H01Q 1/24

(52) U.S. Cl. ..... 343/702; 343/895

(58) Field of Search ..... 343/702, 867, 343/893, 895

(56) References Cited

U.S. PATENT DOCUMENTS

| | | | | |
|---|---|---|---|---|
| 3,852,759 A | * | 12/1974 | Felsenheld et al. | 343/729 |
| 4,161,737 A | | 7/1979 | Albright | 343/749 |
| 4,229,743 A | | 10/1980 | Vo et al. | 343/749 |
| 4,442,438 A | * | 4/1984 | Siwiak et al. | 343/792 |
| 4,644,366 A | | 2/1987 | Scholz | 343/895 |
| 4,772,895 A | | 9/1988 | Garay et al. | 343/895 |
| 5,359,340 A | | 10/1994 | Yokota | 343/895 |
| 5,374,937 A | * | 12/1994 | Tsunekawa et al. | 343/702 |
| 5,469,177 A | | 11/1995 | Rush et al. | 343/702 |
| 5,521,605 A | | 5/1996 | Koike | 343/702 |
| 5,592,184 A | | 1/1997 | Cassel et al. | 343/752 |
| 5,600,341 A | | 2/1997 | Thill et al. | 343/895 |
| 5,668,559 A | | 9/1997 | Baro | 343/702 |
| 5,686,927 A | | 11/1997 | Simmons | 343/702 |
| 5,754,146 A | | 5/1998 | Knowles et al. | 343/895 |
| 5,805,112 A | | 9/1998 | Cassel | 343/702 |
| 5,808,586 A | | 9/1998 | Phillips et al. | 343/895 |
| 5,812,097 A | | 9/1998 | Maldonado | 343/790 |
| 5,923,305 A | | 7/1999 | Sadler et al. | 343/895 |
| 5,963,170 A | | 10/1999 | Garner et al. | 343/702 |
| 5,990,847 A | | 11/1999 | Filipovic et al. | 343/895 |
| 6,005,523 A | | 12/1999 | Rudisill | 343/702 |
| 6,016,130 A | | 1/2000 | Annamaa | 343/895 |
| 6,052,090 A | | 4/2000 | Simmons et al. | 343/702 |
| 6,054,959 A | | 4/2000 | Amos et al. | 343/702 |
| 6,054,962 A | | 4/2000 | Ha et al. | 343/722 |
| 6,054,966 A | * | 4/2000 | Haapala | 343/895 |
| 6,069,592 A | | 5/2000 | Wass | 343/895 |
| 6,075,488 A | | 6/2000 | Hope | 343/702 |
| 6,094,179 A | | 7/2000 | Davidson | 343/895 |
| 6,097,341 A | | 8/2000 | Saito | 343/702 |
| 6,111,545 A | | 8/2000 | Saari | 343/702 |
| 6,115,000 A | | 9/2000 | Otomo et al. | 343/702 |

* cited by examiner

*Primary Examiner*—Shih-Chao Chen
(74) *Attorney, Agent, or Firm*—Ladas & Parry

(57) ABSTRACT

An antenna particularly suitable for a portable communication device and including an elongate portion integrally formed with at least one first coil portion arranged about the elongate portion and in at least partially overlapping relationship therewith. A portable communication device employing the antenna is also described.

20 Claims, 6 Drawing Sheets

PORTABLE ANTENNA

The benefit of U.S. Provisional Patent Application Ser. No. 60/159,461 of Oct. 12, 1999, is claimed.

FIELD OF THE INVENTION

The present invention relates to antennas particularly suitable for portable communications devices and to portable communications devices employing such antennas.

BACKGROUND OF THE INVENTION

A great number of patents describe antennas for use in portable communications devices. The following U.S. Patents are believed to represent the state of the art: U.S. Pat. Nos. 6,111,545; 6,094,179; 6,054,959; 6,054,962; 6,069,592; 6,075,488; 6,016,130; 6,052,090; 5,990,347; 5,963,170; 5,923,305; 5,312,097; 5,808,586; 5,805,112; 5,754,146; 5,668,559; 5,600,341; 5,592,184; 5,359,340; 4,772,895; 4,644,366; 4,229,743; 4,161,737.

SUMMARY OF THE INVENTION

The present invention seeks to provide an improved antenna particularly suitable for use in a portable communications device such as a cellular telephone or a pager as well as a portable communications device including such an antenna There is thus provided in accordance with a preferred embodiment of the present invention an antenna particularly suitable for a portable communication device and including:

an elongate portion integrally formed with at least one first coil portion arranged about the elongate portion and in at least partially overlapping relationship therewith.

The term "coil" is used throughout the specification and claims to refer not only to a three dimensional spring-like coil structure but also to any meandering conductor which can be used as a radiating element in an antenna.

There is also provided in accordance with a preferred embodiment of the present invention a portable communications device including:

a transceiver; and an antenna connected to the transceiver and including an elongate portion integrally formed with at least one first coil portion arranged about the elongate portion integrally formed with at least one first coil portion arranged about the elongate portion and in at least partially overlapping relationship therewith.

Preferably, at least one second coil portion is integrally formed with the elongate portion.

In accordance with a preferred embodiment of the invention, the at least one second coil portion is disposed in non-overlapping relationship with the elongate portion.

In accordance with a preferred embodiment of the present invention, the elongate portion and the at least one first coil portion have separate resonant frequency bands.

Preferably, the elongate portion, the at least one first coil portion and the at least one second coil portion each have separate resonant frequency bands.

In accordance with a preferred embodiment of the present invention, the antenna also includes a mounting portion integrally formed with the elongate portion, the mounting portion including a bent section arranged for spring fit engagement with an electrical contact. It is appreciated that alternatively any other suitable type of mounting portion may be provided, such as a screw or a stud type mount.

There is also provided in accordance with a preferred embodiment of the present invention a portable communications device including:

a transceiver; and an antenna connected to the transceiver and including an elongate portion integrally formed with at least one first coil portion arranged about the elongate portion and in at least partially overlapping relationship therewith.

In accordance with one embodiment of the present invention, the at least one first coil portion is formed as one piece with the elongate portion.

Preferably, the at least one first coil portion extends in a wind-back configuration over at least part of the elongate portion.

In accordance with a preferred embodiment of the present invention, the at least one first coil portion is coaxial with the elongate portion.

Preferably, the antenna also includes at least one second coil portion arranged coaxially with the elongate portion and between the elongate portion and a mounting portion of the antenna.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
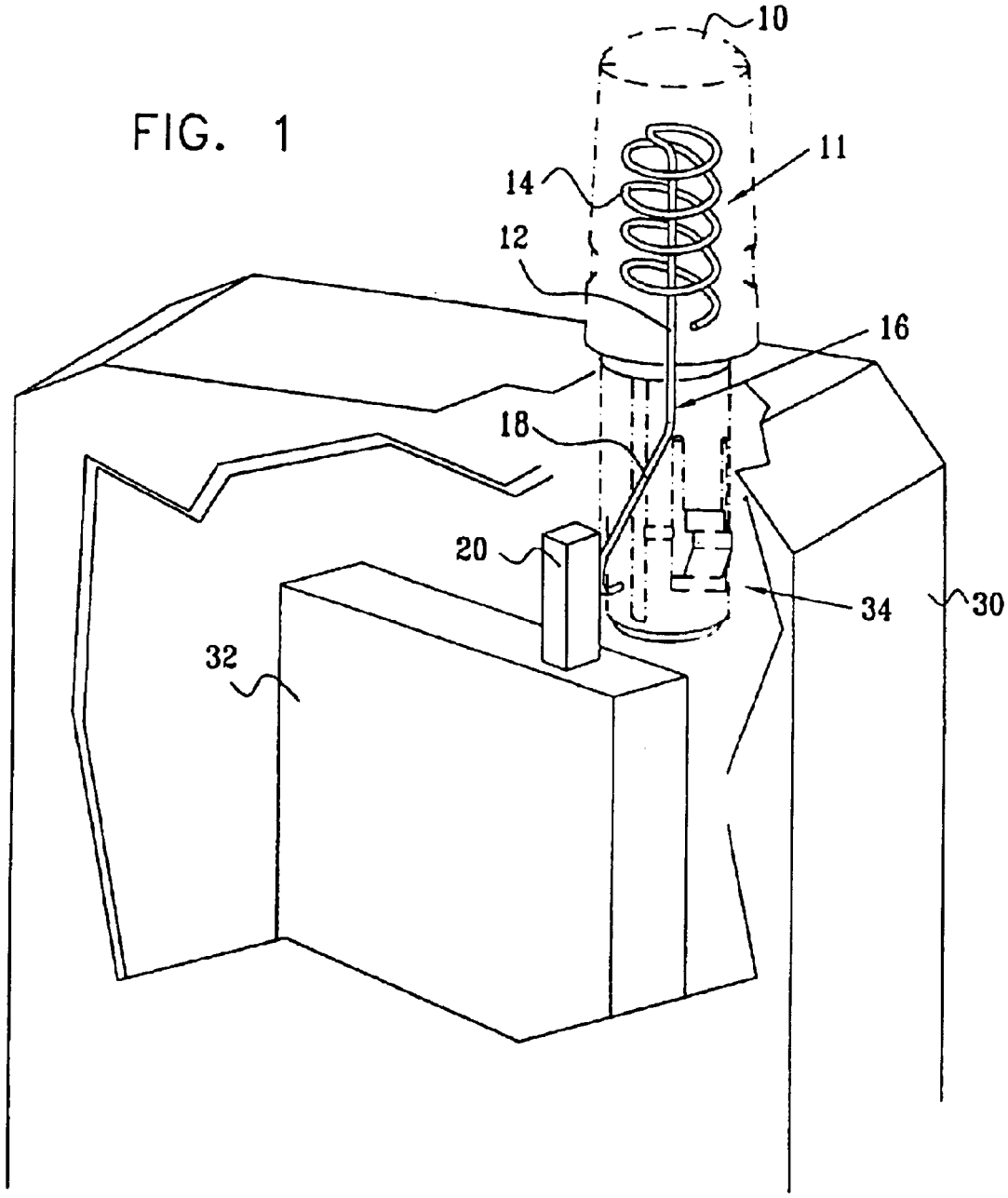
FIG. 1 is a simplified illustration of an antenna constructed and operative in accordance with a preferred embodiment of the present invention having a single windback coil portion.

Reference is now made to FIG. 1, which is a simplified illustration of an antenna constructed and operative in accordance with a preferred embodiment of the present invention having a single windback coil portion.

As seen in FIG. 1, there is provided within an antenna housing sleeve 10, an antenna 11 comprising an elongate portion 12, which is integrally formed with a first coil portion 14. Coil portion 14 is preferably arranged about the elongate portion 12 and in at least partially overlapping relationship therewith, thus defining a windback coil.

In accordance with a preferred embodiment of the present invention, there is also provided a mounting portion 16, which is integrally formed with the elongate portion 12. Preferably, the mounting portion 16 includes a bent section 18 arranged for spring fit engagement with a corresponding electrical contact 20 of a portable communications device 30, which also includes a transceiver 32, coupled to antenna 11 via contact 20. Mounting portion 16 is typically seated in a housing base portion 34.

Figure 2:
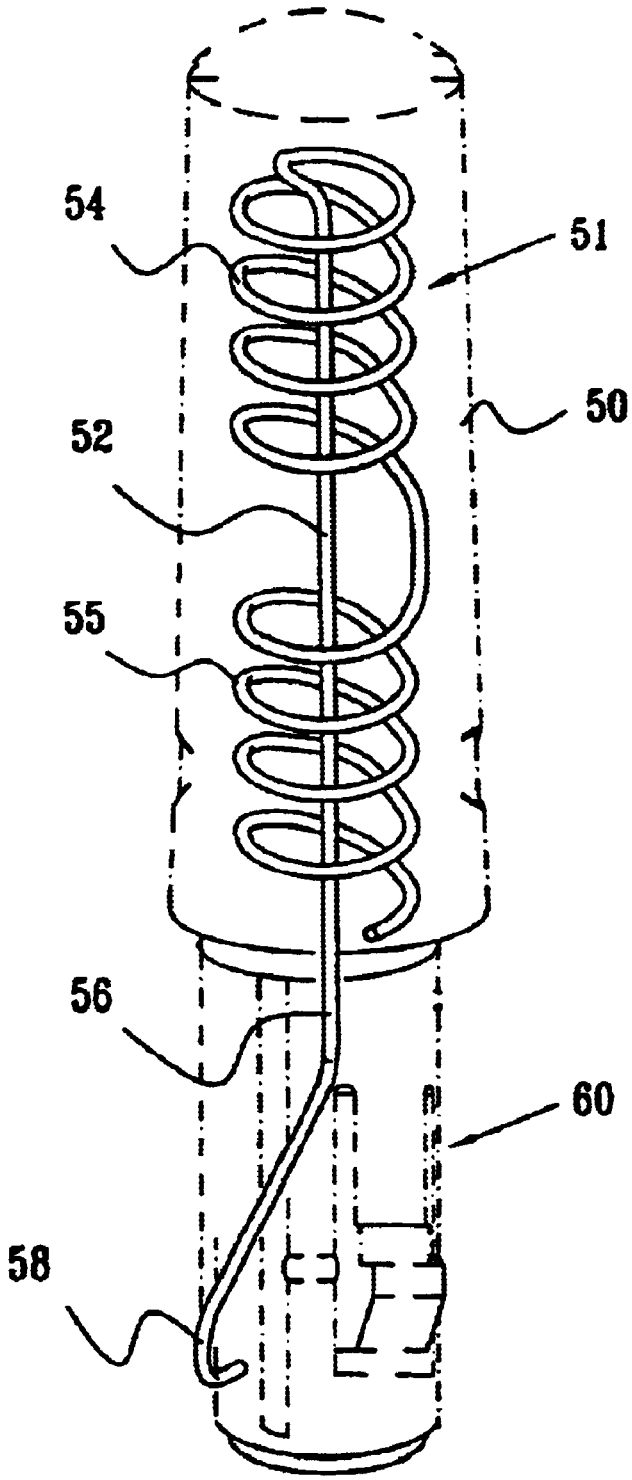
FIG. 2 is a simplified illustration of an antenna constructed and operative in accordance with another preferred embodiment of the present invention having two windback coil portions.

Reference is now made to FIG. 2, which is a simplified illustration of an antenna constructed and operative in accordance with another preferred embodiment of the present invention having two windback coil portions.

As seen in FIG. 2, there is provided within an antenna housing sleeve 50, an antenna 51 comprising an elongate portion 52, which is integrally formed with first and second windback coil portions 54 and 55. Coil portions 54 and 55 are seen to be arranged about the elongate portion 52 and in overlapping relationship therewith.

In accordance with a preferred embodiment of the present invention, there is also provided a mounting portion 56, which is integrally formed with the elongate portion 52. Preferably, the mounting portion 56 includes a bent section 58 arranged for spring fit engagement with a corresponding electrical contact (not shown) of a portable communications device (not shown), which may be identical to portable communications device 30 shown in FIG. 1. Mounting portion 56 is typically seated in a housing base portion 60.

Figure 3:
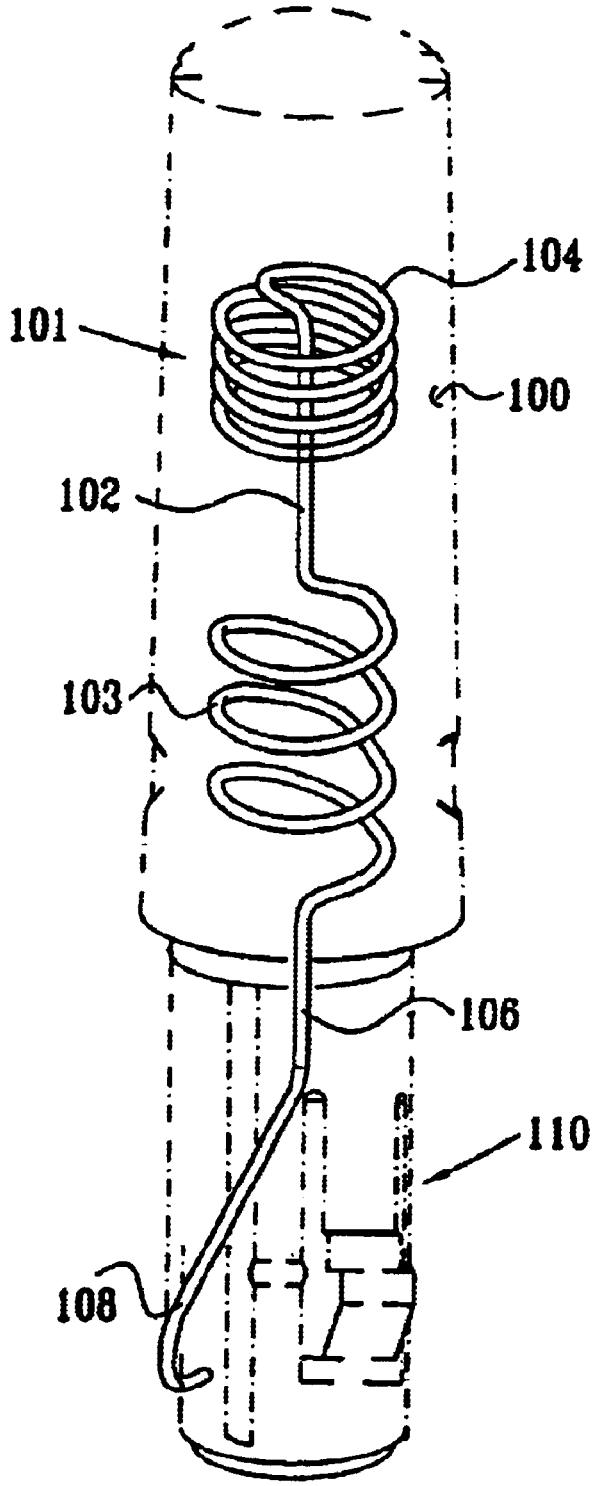
FIG. 3 is a simplified illustration of an antenna constructed and operative in accordance with yet another preferred embodiment of the present invention having two coil portions, one of which is a windback coil portion.

Reference is now made to FIG. 3, which is a simplified illustration of an antenna constructed and operative in accordance with yet another preferred embodiment of the present invention having two coil portions, one of which is a windback coil portion.

As seen in FIG. 3, there is provided within an antenna housing sleeve 100, an antenna 101 comprising an elongate portion 102, which is integrally formed downstream thereof with a coil portion 103 and is integrally formed upstream thereof with a windback coil portions 104. Coil portion 104 is seen to be arranged about the elongate portion 102 and in overlapping relationship therewith.

In accordance with a preferred embodiment of the present invention, there is also provided a mounting portion 106, which is integrally formed with the coil portion 103. Preferably, the mounting portion 106 includes a bent section 108 arranged for spring fit engagement with a corresponding electrical contact (not shown) of a portable communications device (not shown), which may be identical to portable communications device 30 shown in FIG. 1. Mounting portion 106 is typically seated in a housing base portion 10.

Figure 4:
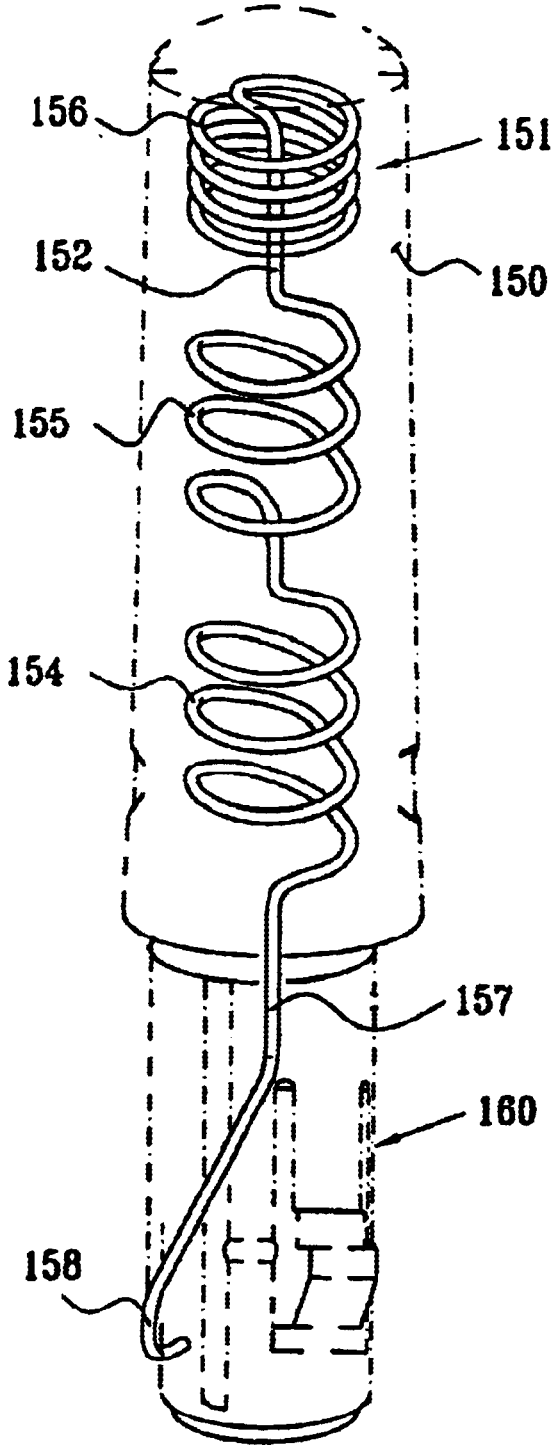
FIG. 4 is a simplified illustration of an antenna constructed and operative in accordance with still another preferred embodiment of the present invention having three coil portions, one of which is a windback coil portion.

Reference is now made to FIG. 4, which is a simplified illustration of an antenna constructed and operative in accordance with still another preferred embodiment of the present invention having three coil portions, one of which is a windback coil portion.

As seen in FIG. 4, there is provided within an antenna housing sleeve 150, an antenna 151 comprising an elongate portion 152, which is integrally formed upstream thereof with first and second coil portions 154 and 155 and is integrally formed downstream thereof with a windback coil portion 156. Coil portion 156 is seen to be arranged about the elongate portion 152 and in overlapping relationship therewith.

In accordance with a preferred embodiment of the present invention, there is also provided a mounting portion 157, which is integrally formed with coil portion 154. Preferably, the mounting portion 157 includes a bent section 158 arranged for spring fit engagement with a corresponding electrical contact (not shown) of a portable communications device (not shown), which may be identical to portable communications device 30 shown in FIG. 1. Mounting portion 157 is typically seated in a housing base portion 160.

Figure 5:
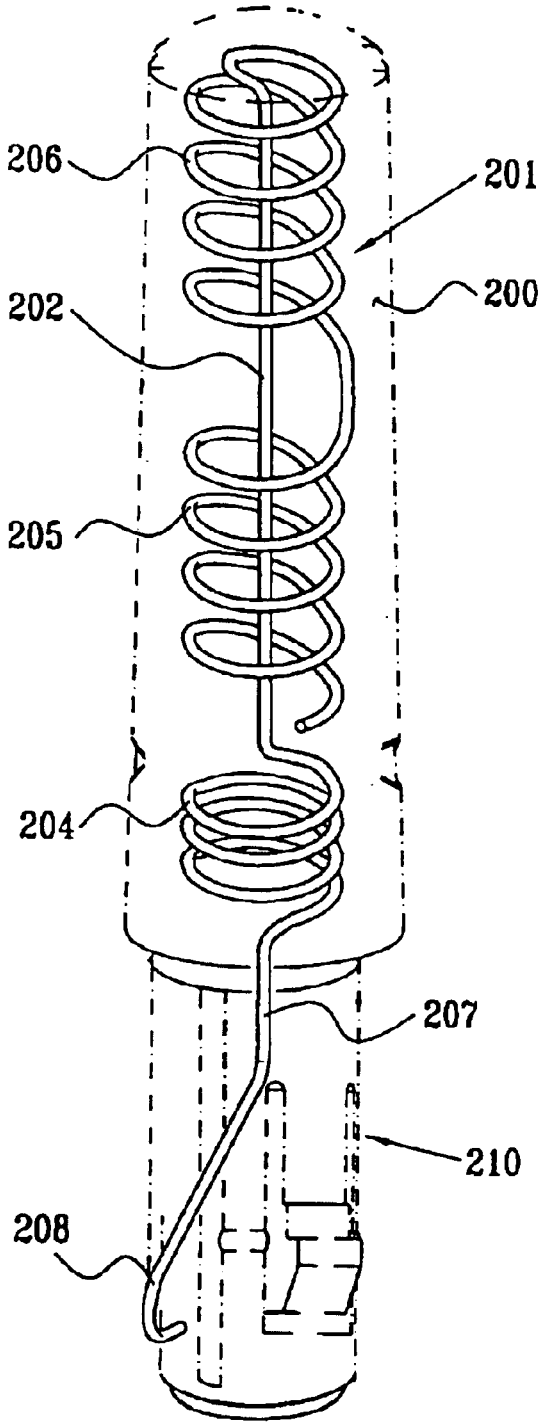
FIG. 5 is a simplified illustration of an antenna constructed and operative in accordance with a further preferred embodiment of the present invention having three coil portions, two of which are windback coil portions.

Reference is now made to FIG. 5, which is a simplified illustration of an antenna constructed and operative in accordance with a further preferred embodiment of the present invention having three coil portions, two of which are windback coil portions.

As seen in FIG. 5, there is provided within an antenna housing sleeve 200, an antenna 201 comprising an elongate portion 202, which is integrally formed upstream thereof with a coil portion 204 and is integrally formed downstream thereof with first and second windback coil portions 205 and 206. Coil portions 205 and 206 are seen to be arranged about the elongate portion 202 and in overlapping relationship therewith.

In accordance with a preferred embodiment of the present invention, there is also provided a mounting portion 207, which is integrally formed with the coil portion 204. Preferably, the mounting portion 207 includes a bent section 208 arranged for spring fit engagement with a corresponding electrical contact (not shown) of a portable communications device (not shown), which may be identical to portable communications device 30 shown in FIG. 1. Mounting portion 207 is typically seated in a housing base portion 210.

Figure 6:
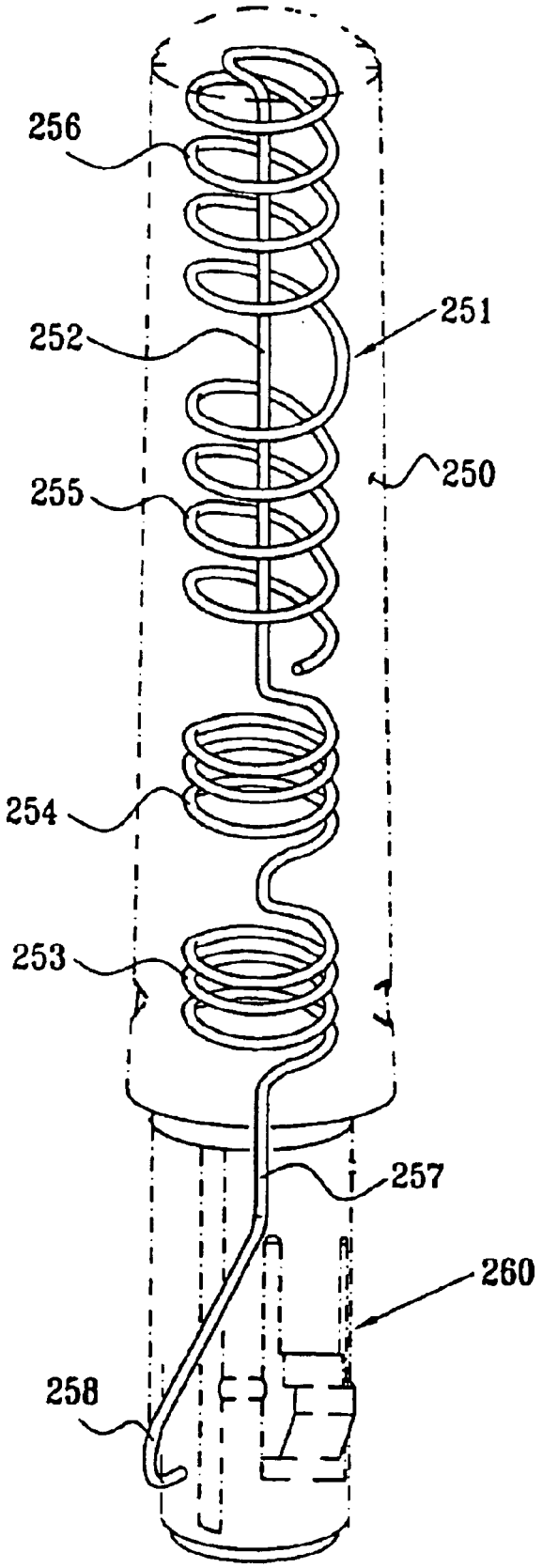
FIG. 6 is a simplified illustration of an antenna constructed and operative in accordance with yet another preferred embodiment of the present invention having four coil portions, two of which are windback coil portions.

Reference is now made to FIG. 6, which is a simplified illustration of an antenna constructed and operative in accordance with yet another preferred embodiment of the present invention having four coil portions, two of which are windback coil portions.

As seen in FIG. 6, there is provided within an antenna housing sleeve 250, an antenna 251 comprising an elongate portion 252, which is integrally formed upstream thereof with first and second coil portions 253 and 254 and is integrally formed downstream thereof with first and second windback coil portions 255 and 256. Coil portions 255 and 256 are seen to be arranged about the elongate portion 252 and in overlapping relationship therewith.

In accordance with a preferred embodiment of the present invention, there is also provided a mounting portion 257, which is integrally formed with coil portion 253. Preferably, the mounting portion 257 includes a bent section 258 arranged for spring fit engagement with a corresponding electrical contact (not shown) of a portable communications device (not shown), which may be identical to portable communications device 30 shown in FIG. 1. Mounting portion 257 is typically seated in a housing base portion 260.

It is a particular feature of the present invention that multi-band and/or wide band antenna performance is provided by an antenna including a single piece conductor.

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

What is claimed is:

1. An antenna particularly suitable for a portable communication device and including:

a elongate portion integrally formed with at least one first coil portion arranged about the elongate portion and in at least partially overlapping relationship therewith, said antenna having a single feed end and a single free end.

2. The antenna according to claim 1 and also comprising at least one second coil portion integrally formed with said elongate portion.

3. The antenna according to claim 2 and wherein said at least one second coil portion is disposed in non-overlapping relationship with said elongate portion.

4. The antenna according to claim 1 and wherein said elongate portion and said at least one first coil portion have separate resonant frequency bands.

5. The antenna according to claim 2 and wherein said elongate portion, said at least one first coil portion and said at least one second coil portion each have separate resonant frequency bands.

6. The antenna according to claim 1 and also comprising a mounting portion integrally formed with said elongate portion, said mounting portion including a bent section arranged for spring fit engagement with an electrical contact.

7. A portable communications device comprising:

a transceiver; and an antenna connected to said transceiver and including an elongate portion integrally formed with a least one first coil portion arranged about the elongate portion and in at least partially overlapping relationship therewith, said antenna having a single feed and a single free end.

8. The portable communications device according to claim 7 and also comprising at least one second coil portion integrally formed with said elongate portion.

9. The portable communications device according to claim 8 and wherein said at least one second coil portion is disposed in non-overlapping relationship with said elongate portion.

10. The portable communications device according to claim 8 and wherein said elongate portion and said at least one first coil portion have separate resonate frequency bands.

11. The portable communications device according to claim 8 and wherein said elongate portion, said at least one first coil portion and said at least one second coil portion have separate resonate frequency bands.

12. The portable communications device according to claim 8 and also comprising a mounting portion integrally formed with said elongate portion, said mounting portion including a bent section arranged for spring fit engagement with an electrical contact.

13. The antenna according to claim 1 and wherein said at least one first coil is formed as one piece with said elongate portion.

14. The antenna according to claim 13 and wherein said at least one first coil portion extends in a wind-back configuration over at least part of said elongate portion.

15. The antenna according to claim 14 and wherein said at least one first coil portion is coaxial with said elongate portion.

16. The antenna according to claim 14 and also comprising at least one second coil portion arranged coaxially with said elongate portion and between said elongate portion and a mounting portion of said antenna.

17. A portable communication device comprising:

a transceiver; and an antenna cooperating with said transceiver, said antenna having a single feed end and a single free end and also comprising:

an elongate portion integrally formed with at least one first coil portion arranged about the elongate portion and in at least partially overlapping relationship therewith, wherein said at least one first coil portion is formed as one piece with said elongate portion.

18. The portable communication device according to claim 17 and wherein said at least one first coil portion extends in a wind-back configuration over at least part of said elongate portion.

19. The portable communication device according to claim 18 and wherein said at least one first coil portion is coaxial with said elongate portion.

20. The portable communication device according to claim 18 and also comprising at least one second coil portion arranged coaxially with said elongate portion and between said elongate portion and a mounting portion of said antenna.

* * * * *